US008820521B2

(12) United States Patent
Hodgson et al.

(10) Patent No.: US 8,820,521 B2
(45) Date of Patent: Sep. 2, 2014

(54) REFILL UNIT FOR A MOIST SMOKELESS TOBACCO PRODUCT

(75) Inventors: Richard Hodgson, London (GB); Steve Dickason, London (GB)

(73) Assignee: British American Tobacco (Investments) Limited, London (GB)

( * ) Notice: Subject to any disclaimer, the term of this patent is extended or adjusted under 35 U.S.C. 154(b) by 1173 days.

(21) Appl. No.: 12/598,710

(22) PCT Filed: Apr. 29, 2008

(86) PCT No.: PCT/EP2008/055271

§ 371 (c)(1),
(2), (4) Date: Apr. 26, 2010

(87) PCT Pub. No.: WO2008/135468

PCT Pub. Date: Nov. 13, 2008

(65) Prior Publication Data

US 2010/0206320 A1 Aug. 19, 2010

(30) Foreign Application Priority Data

May 4, 2007 (SE) ..... 0701087

(51) Int. Cl.

| | |
|---|---|
| ***B65D 85/00*** | (2006.01) |
| ***A24F 23/00*** | (2006.01) |
| *A45C 11/00* | (2006.01) |

(52) U.S. Cl.

CPC *A24F 23/00* (2013.01); *A45C 11/00* (2013.01)
USPC ..... 206/265; 313/347

(58) Field of Classification Search

CPC ..... A24F 23/00
USPC ..... 493/51; 29/428; 131/112, 275, 347, 131/352, 354, 366; 206/256, 265, 459.5, 206/242; 221/45; 132/293–307; 220/23.87
See application file for complete search history.

(56) References Cited

U.S. PATENT DOCUMENTS

| | | | | |
|---|---|---|---|---|
| 3,620,399 | A * | 11/1971 | Rapeaud | 215/12.1 |
| 5,259,498 | A * | 11/1993 | Weisburn et al. | 206/756 |
| 5,938,016 | A * | 8/1999 | Erdtmann | 206/221 |
| 2002/0139093 | A1 * | 10/2002 | Landau | 53/474 |
| 2008/0110920 | A1 * | 5/2008 | Hlista et al. | 221/45 |

FOREIGN PATENT DOCUMENTS

| | | | |
|---|---|---|---|
| DE | 16 32 656 | A1 | 12/1970 |
| DE | 91 11 696 | U1 | 1/1992 |
| DE | 9111696 | U1 | 1/1992 |
| EP | 1 442 866 | A | 8/2004 |

(Continued)

OTHER PUBLICATIONS

FR 2745276 (Machine Translation) [online], [retrieved on Nov. 3, 2012], retrieved from EPO Database (http://worldwide.espacenet.com/?locale=en_EP).*

(Continued)

*Primary Examiner* — Richard Crispino
*Assistant Examiner* — Yana B Krinker
(74) *Attorney, Agent, or Firm* — N W Poulsen; L A Pinol

(57) ABSTRACT

Packaging for moist smokeless tobacco can be provided in the form of a refill unit comprising a base portion (10) configured to fit in the bottom of an existing moist smokeless tobacco product container and a lid portion (30).

15 Claims, 3 Drawing Sheets

(56) References Cited

FOREIGN PATENT DOCUMENTS

| | | | | | |
|---|---|---|---|---|---|
| FR | 555 167 | A | | 6/1923 | |
| FR | 2 745 276 | A | | 8/1997 | |
| FR | 2745276 | | * | 8/1997 | ..... A45D 40/00 |
| GB | 404 315 | A | | 1/1934 | |
| GB | 1269783 | | * | 4/1969 | ..... B65D 77/04 |
| GB | 1 269 783 | A | | 4/1972 | |
| JP | 5065828 | U | | 8/1993 | |
| JP | 6078230 | U | | 11/1994 | |
| WO | WO 86/06044 | A | | 10/1986 | |

OTHER PUBLICATIONS

International Search Report and Written Opinion, mailed on Aug. 26, 2008.

Communication issued by the European Patent Office for related Application No. EP08749872.1 dated Jun. 30, 2010.

International Preliminary Report on Patentability dated Nov. 10, 2009, for International Application No. PCT/EP2008/055271.

* cited by examiner

REFILL UNIT FOR A MOIST SMOKELESS TOBACCO PRODUCT

CLAIM FOR PRIORITY

This application is a National Stage Entry entitled to and hereby claims priority under 35 U.S.C. §§365 and 371 corresponding to PCT Application No. PCT/EP2008/055271, titled, "Refill unit for a moist smokeless tobacco product," filed Apr. 29, 2008, which in turn claims priority to Swedish Application Serial No. SE 0701087-9, filed May 4, 2007, all of which are hereby incorporated by reference.

FIELD OF THE INVENTION

The invention relates generally to the field of packaging. More specifically, the invention relates to packaging for moist smokeless tobacco products.

BACKGROUND OF THE INVENTION

Among the broad array of tobacco products offered on the market today there is a class of goods intended for oral administration which do not require combustion. Examples include chewing tobacco, snus, and moist snuff.

Chewing tobacco is typically treated by dipping or spraying a sweetening and flavouring composition, called casing, on the cured tobacco leaves and partially drying the tobacco before forming the leaves into the desired final product and packaging the same. Snus is another moist tobacco product which is provided in loose form or in individually-wrapped pouches. It contains tobacco which has been cured, humidified, and flavoured in a pasteurization-like process. Snuff, when provided in moist form, is similar to chewing tobacco in that it is also typically treated with moisture agents and humectants in a casing process.

All of the aforementioned products have high moisture content and typically also have acidic pH values. The limitations on shelf life for a natural product like tobacco are exacerbated by the presence of significant amounts of moisture and often additional microbial food sources such as sweeteners and flavouring agents.

Due to both the product constraints and consumer preference, these products are generally provided in a stout cylindrical or oval package which is portable but protects the product from crushing and which forms an effective moisture barrier. Examples include cardboard or paperboard formed cans coated with paraffin or other inert moisture barrier agent. Lids are often polypropylene. Particularly with snus products, the goods are often provided in small lidded drums formed of polypropylene or other suitable plastic. Metal containers are known, however, in addition to the negative impact on product performance seen with prolonged storage in any container, metal containers themselves may suffer damage due to the moisture and acidity of the contents.

The type of packaging that is provided for moist smokeless tobacco products must be durable and form a protective environmental barrier for the goods, but there are drawbacks to providing extensive and heavy packaging. Costs and space requirements for transport and storage are significant, as is the environmental impact of extensive packaging.

While present packaging options are generally suitable for keeping the product clean, moist, and free from physical stress, there remains a need in the art to further develop packaging options for moist smokeless tobacco products.

SUMMARY OF THE INVENTION

It is therefore an object of the present invention to provide a new package for moist smokeless tobacco products which meets these demands and improves on the knowledge in the art.

According to an embodiment of the invention, a refill unit for a moist smokeless tobacco product is provided which comprises a base portion and a lid portion partially or fully removably attached to the base portion to define a storage space when the lid portion is attached to the base portion, wherein the base portion is configured to fit inside a moist smokeless tobacco product container.

The lid portion can be resealably removeable from the base portion. A wrapper can be disposed outside the attached lid and base portions. The base portion can comprise a bottom wall and a side wall extending upwardly therefrom. The bottom wall of the base portion could be circular, with cylindrical side walls. Alternatively, the bottom wall of the base portion could be oval, with elliptical side walls.

Such a refill unit could have a lip extending outwardly or inwardly from an upper edge of the side wall. The lid portion could be attached to the lip of the base portion. Such a refill unit could further comprise a moist smokeless tobacco product in the storage space.

According to an embodiment of the invention, there is provided a moist smokeless tobacco product which comprises at least one refill unit according to the previous embodiment and at least one moist smokeless tobacco product container.

As used herein, the term "moist smokeless tobacco product container" refers to containers existing in the art or developed subsequent to this disclosure which are designed to contain a portion of moist smokeless tobacco. Such containers are typically available to consumers as single units or in multi-unit packages. Examples include molded plastic drums with removeable plastic lids. Lids may comprise a recloseable storage space for used tobacco product.

"Moist smokeless tobacco product" is used herein to denote tobacco products having at least 10% moisture and which are not intended for combustion. The moisture level in the product may include water, humectants, liquid additives such as flavourants, and/or other compounds or compositions. Known moist smokeless tobacco products include standard chewing tobacco, which typically has a moisture content of 10%, or 15%, or 20%, or 25%, or 30%, or 35%, or 40%, or 45%, or 50%, or 55%, or 60%; snus, which typically has a moisture content of 40%, or 45%, or 50%, or 55%, or 60%, or 65%, or 70%; and moist snuff, which typically has a moisture content of 30%, or 35%, or 40%, or 45%, or 50%, or 55%, or 60%. Additives may be incorporated in these products to reduce the overall moisture and/or water activity of the final product, however, for the purposes of this invention such final products would still be considered to comprise moist smokeless tobacco.

"Tobacco" as used herein includes any part, e.g., leaves, flowers, stems, of any member of the genus *Nicotiana* and reconstituted materials thereof. It includes derivatives such as specific compounds found in natural tobacco, e.g., nicotine, whether extracted or synthesized, as well as structural derivatives such as the fibrous portion of a tobacco leaf. It further includes tobacco substitutes which comprise individual chemicals and/or complex chemical entities which, when appropriately prepared, physically resemble natural tobacco.

BRIEF DESCRIPTION OF THE DRAWINGS

In order that the present invention be easily understood and readily carried into effect, reference will now be made, by way of example, to the accompanying diagrammatic drawings in which.

DETAILED DESCRIPTION

Figure 1:
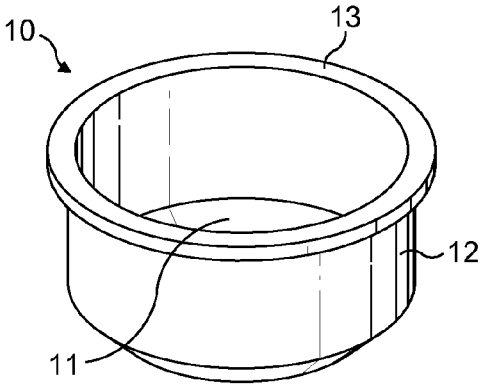
FIG. 1 shows a perspective view of a base of a refill unit according to the invention.

In addition to a wide range of evolving product choices, producers of moist smokeless tobacco are increasingly offering consumers novel and innovative containers. In the process of meeting consumer expectations for a container that is crush resistant and as airtight as reasonably possible, producers have designed some very sturdy and attractive packages. In order to provide the desired environmental barrier properties along with integral strength and integrity, many producers have turned to plastics and polypropylene in particular, as noted above. Others of the producers have relied on metals or metal alloys in whole or in part.

While the materials used in many moist smokeless tobacco containers are recyclable, there is nonetheless an environmental burden inherent in their production as well as in the collection, sorting, cleaning and recycling processes. Some percentage of containers are not recycled but disposed of, burdening landfills.

Furthermore, the cost of producing packaging and transporting it to the moist smokeless tobacco production location is considerable. Packaging also contributes substantially to the final weight and dimensions of the product, which affects shipping and storage costs and related consumption of energy and release of waste products.

Despite these drawbacks, producers need to offer packaging which meets consumer expectations. Sturdiness, for example, is necessary if the product is not to be crushed. Crushed moist smokeless tobacco is not only less aesthetically appealing, it may suffer diminished performance particularly where the product is provided loose to the consumer. Compression caused by crushing of the outer packaging makes it more difficult to judge how much product they are using and also results in a different organoleptic experience than with uncompressed product.

Another important packaging aspect for consumers of moist smokeless tobacco products is hygiene. The products are generally viewed in a similar way to food items and as such the packaging needs to be provided in a sanitary state and be designed in such a way so as to remain suitably clean during use of the product. The aspects of packaging which help maintain a clean product often also contribute to protecting the product from excesses of moisture or dryness and other environmental factors which would have an undesired impact on product performance.

Despite the variety now available, many of the moist smokeless tobacco containers have a generally similar design. They comprise a cylindrical bottom portion and a lid which may be an interlocking cylinder or circular with engaging means to removably attach it to the bottom portion. They are sized to be portable and easily carried on the person of the user. For example, some existing containers are approximately 7 cm in diameter and 2.5 cm in height.

According to the invention, a refill is provided which offers the hygienic single-use aspect of existing products. However, as the refill unit need not have the same degree of structural integrity it can be prepared using smaller amounts and/or different materials. The unit need only have sufficient integrity to protect the product during packaging and shipping. Because the consumer will not use it singly but in conjunction with an existing moist smokeless tobacco container, it can be comparatively weak.

The refill unit is provided in a closed, environmental barrier fashion, but the closure or lid present need not be replaceable or resealable. Despite this, it may be preferred in some circumstances to have a lid portion which is at least replaceable. For example, where an existing moist smokeless tobacco container is made of metal, by providing a refill unit to house the subsequent portions of product the metal will be protected to some degree from degradation caused by the product, In that case, then, having protection for not only the body of the container but also the inside of the lid may be preferred.

Base

The base portion of the refill unit of the invention is configured to be removably stored in a moist smokeless tobacco product container. It is shaped to fit inside the inner contours of existing containers to maximize available space, but with sufficient clearance from the existing container to account for manufacturing tolerances and to allow the refill unit to be easily removable.

In circumstances where it may be desirable for the base portion to fit more snugly in the existing container a removal means could be provided to facilitate exchange of refill units.

Referring now to FIG. 1, according to one embodiment, a base 10 is depicted which would be suitable for use with standard existing designs of moist smokeless tobacco containers. It comprises a circular bottom wall 11 and a cylindrical side wall 12 extending upwardly therefrom. A lip 13 extends outwardly from the top edge of side wall 12. In use, lip 13 may engage the upper edge of a side wall of an existing moist smokeless tobacco container.

Figure 2:
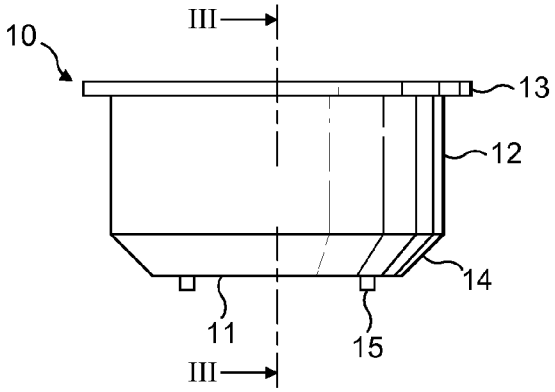
FIG. 2 shows a side view of a base of a refill unit according to the invention.
Figure 3:
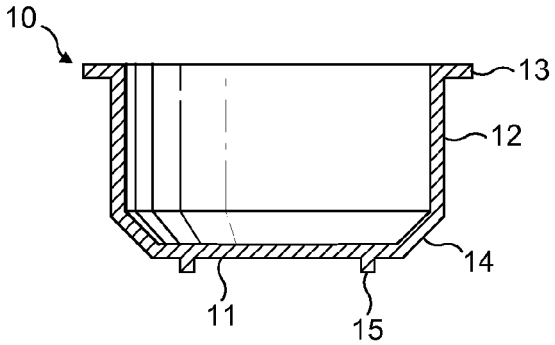
FIG. 3 shows a cross-sectional view of the base of FIG. 2.

FIG. 2 shows an alternative embodiment of a base 10 in which a bottom wall 11 and side wall 12 are joined along a tapered bottom 14 of side wall 12. Furthermore, a ridge 15 is provided on bottom wall 11 which ridge may engage the inside of a bottom surface. A cross-sectional view of the embodiment of FIG. 2 taken along lines III-III is shown in FIG. 3. Ridge 15 could be of a variety of configurations and dimensions. Ridge 15 is one option for configuring a refill unit which utilizes the minimum amount of material but still fits an existing moist smokeless tobacco container. There are numerous containers on the market which are of dimensions significantly larger than required to hold a full unit of product. By placing a ridge or other downwardly extending member along the bottom wall of the refill unit, the top of the unit will be flush with the top of the existing container but have a shorter side wall than would otherwise be required for the refill unit to sit firmly on the base of the existing container.

Another potential advantage which may be experienced by users who do not wipe out any moisture or residue left in their moist smokeless tobacco container when the original portion of product is consumed is that there will be less contact between the material of the existing container and the material of the refill unit. This may discourage or delay microbial activity in the space between the container and the refill unit and may help facilitate removal of the refill unit once empty by minimizing surface areas which could be prone to stick to one another.

Alternatively, the base may be both free from ridges or similar means and be positioned above the inside of the bottom surface of an existing container while in use. Such an embodiment even further reduces material consumption.

Figure 4:
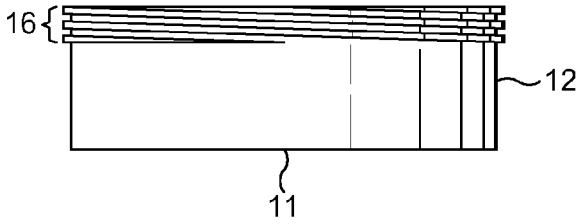
FIG. 4 shows a side view of a base of a refill unit according to the invention.

FIG. 4 shows a base 10 which comprises a bottom wall 11 and a side wall 12. The means provided for the base to engage an existing moist smokeless tobacco container are threads 16 along the top edge of side wall 12. Threads 16 are configured to engage opposing threads on the inside of the upper end of the corresponding wall of a container. In use, a user would gently press a refill unit provided with threads while rotating the unit and/or the container to interlock the opposing threads. To remove the refill unit a similar motion whilst rotating in the opposite direction would free the refill unit from the container.

A broad range of materials could be used to form the base portion of a refill unit of the invention. Guiding principles would be to provide a material which can be used in conjunction with food grade products. Toxicity or unpleasant odour or aroma caused by the material or by a reaction between the material and product stored therein would be undesired. While reactivity with regard to the product is generally disfavoured, one nonetheless may choose to provide a material which releases agents such as flavourants or perfumes which would contribute to the appealing nature of the product stored therein.

Due to the unique nature of moist smokeless tobacco it could also be preferred to choose materials which may be cleaned to a high standard of hygiene. This would reduce the need to prepare, package and transport the bases under strict hygiene requirements but would instead allow for a final cleaning prior to dispensing the product therein.

Certain plastics are particularly well suited to use with food products as they can form a smooth surface which is tolerant of cleaning with industrial agents, leaving a container which is generally free of soil or microbial agents. Metals and metal alloys can also be employed; these materials can also be chosen for their ability to be cleaned with strong agents and/or heat. Although it has been noted that metals and metal alloys can suffer damage when used to store moist, acidic materials for a long period, the refill unit is designed to be used for a limited period of time and then recycled or otherwise disposed of. The oxidation that may be observed when, e.g., a 50% moisture product having a pH of 8 is stored for many months in an uncoated metal container could be avoided in the refill unit by providing for shorter turn around times for packing, delivery, and use.

In addition to providing a material which is generally clean and non-reactive, consideration can be given to mechanical properties of the material. Due to the nature of the processing and storage of certain moist smokeless tobacco products, the materials in which they are stored ideally perform well under refrigeration (4° C.). Because a package experiences a certain range of temperatures during its useful life, though, a material which performs well at temperatures from at or below 0° C. to at or above 40° C. could provide benefits to the refill unit. Certain plastics are known to be stiff and, if struck or compressed, to splinter when stored at low temperatures. Such plastics might be less favoured for this reason.

Finally, the material used to form the base may in some applications preferably form an effective moisture and microbial/insect barrier for the goods stored therein.

Multi-layer materials could be employed. To facilitate disposal pre-formed compression means to such as rings around the side wall could be provided, making it easier for a user to flatten the base of an empty refill unit.

While existing moist smokeless tobacco products are not particularly light sensitive, consideration may be given to using a material which is light resistant. In particular, where the refill unit is intended to be stored in a bright environment and a dark product is able to absorb radiation and create a greenhouse effect within the refill unit, measures could be taken to provide suitable materials or coatings to reduce the chance of product overheating.

Mechanical tolerances should be noted when practicing the invention, but it should be evident that some small amount of play may be preferred such that the refill is easily placed in and withdrawn from the container. Alternatively, the fit could be loose in some areas but the refill could be provided with engaging means such at interacting threads, adhesive, static, or the like. Certain engaging means could allow for a single configuration of refill that would fit a range of existing containers having similar overall shapes but slight variation in inner measurements.

As with many technologies, availability, cost, ease of use and the like may also be taken into account when choosing a material to employ in the practice of the invention.

Lid

The lid portion of the refill unit of the invention is designed to be sealingly engaged with the base portion when provided to the user. The lid may be removeable or resealable. The lid may cover any open portion of the base.

Figure 5:
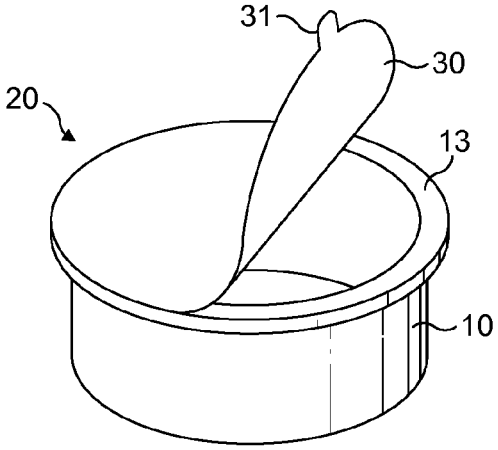
FIG. 5 shows a refill unit of the invention having a partially-removed lid.

By way of illustration, an embodiment of a refill unit 20 is shown in FIG. 5, where a base 10 having a lip 13 is provided with a lid 30. Lid 30 has a tab 31 to facilitate disengagement of lid 30 from lip 13, to which it has been sealingly affixed. Lid 30 is shown partially removed in FIG. 5.

Figure 6:
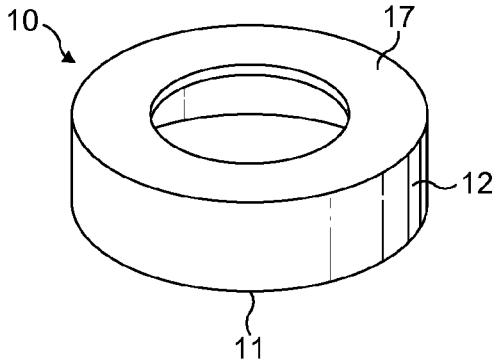
FIG. 6 shows a perspective view of a base of a refill unit according to the invention.
Figure 7:
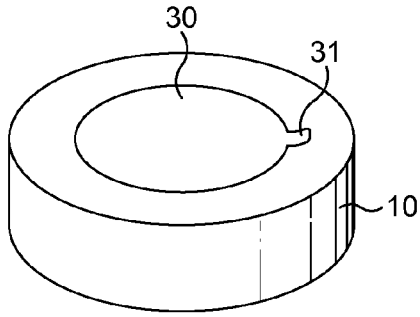
FIG. 7 shows a refill unit comprising the base of FIG. 6 and a lid.

An alternative embodiment of a base 10 is shown in FIG. 6, where a bottom wall 11 has an upwardly-extending side wall 12 which contacts at an upper edge a partial top wall 17. Partial top wall 17 defines an open area which allows access to product stored in base 10. As shown in FIG. 7, a lid 30 can be provided over the opening defined by a partial top wall and a tab 31 can also be provided to facilitate removal of lid 30. The embodiment shown in FIGS. 6 and 7 may be particularly well suited to a resealable lid as the product designer can choose a width for the partial top wall that provides the ideal surface area to engage a resealable lid, while still providing an opening of sufficient size to allow access to the contents. A variety of different lid shapes could be used and/or a variety of differently-shaped openings.

As with the base, the materials chosen for the lid can vary based on the desired configuration of the refill unit. Preferable materials perform well under the environmental conditions experienced by moist smokeless tobacco during packing, transport, storage and use. Food-grade materials which are or can be cleaned to a high standard, and which form an effective environmental barrier may be preferred. Films including multi-layer films and foils could be employed.

For simplicity and ease of manufacture the same material could be used for the base and the lid; in that case the design of the refill unit should accommodate the formation of a seal between the lid and the base, whether by mechanical means such as interlocking shapes, or by the use of sealing means such as an adhesive or an adhesive tape. It may be possible to prefabricate the lid and base in such a way that they form a single unit with a fault line or area of deformation for access by the user.

Attachment of the lid to the base may be done at any suitable manufacturing step, either before or after the refill unit is charged with contents. For example, it may be preferred to form a side and top portion of a refill unit separately from the base portion and to fill the contents through the open bottom before sealing the base on the refill unit. Preparing and portioning of moist smokeless tobacco products may be performed in any way provided in the art.

There the lid is designed to be placed on the base after contents are in place, consideration may be given to the choice of sealing means such that the product is not negatively impacted. For example, materials which would require lengthy contact times and particularly high temperatures for form a heat seal might not be preferred where the contents are temperature sensitive. Adhesives used should be compatible with the goods stored within the refill unit, for example, adhesives used to seal lids on food containers may provide certain benefits such as being sanitary and non-toxic. Tacky adhesives would be useful for certain purposes whereas for other arrangements a permanent adhesive would be preferred. Adhesives which do not perform well under refrigeration would be disfavoured for use with refrigerated products.

As retail and cultural conditions vary, other features may be incorporated in the refill unit of the invention. For example, it can be preferred for consumers to have a tamper resistant or tamper evident packaging to verify the authenticity and undisturbed nature of the goods therein.

The refill unit of the invention also provides opportunities to offer aesthetically appealing product configurations. For example, a base portion with a partial top wall will only allow user access to a portion of the goods stored therein when full. When used in conjunction with portioned products such as portion snus in pouches, it may therefore be desired to arrange the pouches in such a way so as to simplify removal of a single pouch and reduce the chance that a plurality of pouches escape from the refill unit when a user intends to remove only one.

Where material and design choices allow, the moist smokeless tobacco products may be vacuum sealed in the refill unit. Where thin layers of lightweight, easily deformed plastics are chosen as the base materials, vacuum packing may not be possible. Instead a later of inert gas, e.g., flushing with nitrogen prior to sealing, may be preferred in some applications to reduce exposure of the moist smokeless tobacco products to the ambient air during transport and storage. Flavourants, humectants, or other agents may be provided to the refill unit before, during, or after filling with product.

Either in addition to a lid or instead of a lid, shrink wrapping may be provided to the base. A shrink wrap could provide an additional barrier and an additional surface with which one could communicate with consumers. Furthermore, where the material used in the shrink wrap could form an environmental barrier for the goods in the refill unit, material requirements for the base could be altered. For example, where a shrink wrap forms a complete seal and an effective moisture, aroma and soil/microbial barrier, the base could be formed of a porous material such as cellulose-based products, similar to a stout version of a paper drinking cup. To avoid weakening and discolouration when employed in the present invention, porous materials such as papers may preferably be coated on any moist smokeless tobacco-contacting surface.

A single or a plurality of refill units of the invention may be provided with additional packaging such as a paperboard or cardboard sleeve holding a stack of refill units. Even where multiple packaging materials are used for storage and transport, the refill unit can nonetheless offer a reduced amount of overall material, as well as reduced weight and dimensions which provides a positive impact on transport costs and related energy consumption. The resultant product offers consumers a hygienic, fresh product that can be used in conjunction with existing containers which the user may choose based on ergonomics or textural qualities.

Example 1

Drop-In Refill with Peel-Off Lid

Figure 8:
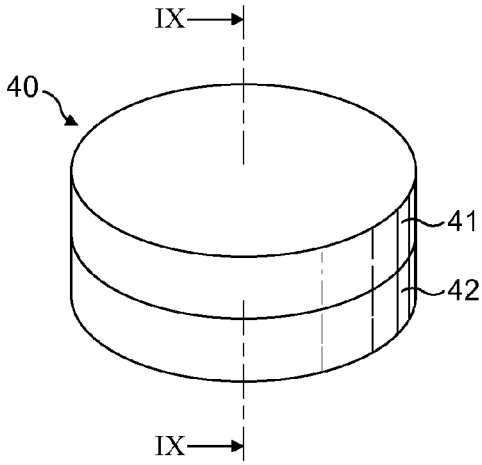
FIG. 8 PRIOR ART
FIG. 8 shows a perspective view of a prior art moist smokeless tobacco container.

An existing moist smokeless tobacco container is provided having a cylindrical shape. An example is shown in FIG. 8, where a container 40 comprises a top portion 41 and a bottom portion 42. Bottom portion 42 has an inner diameter of 5.8 cm. When in a closed position as shown, container 40 has an inner height of 2.2 cm.

A cylindrical refill unit similar to that shown in FIGS. 2 and 3 is provided having an outer diameter of 5.5 cm and a height of 2.2 cm. The refill unit comprises an injection moulded polypropylene base and a peelable lid affixed thereto with an adhesive. A portion of moist smokeless tobacco is provided in the refill unit.

A user consumes the product provided in an existing moist smokeless tobacco container. The user then removed the peelable lid from a refill unit, places the refill unit in the container, and replaces the container top portion.

Figure 9:
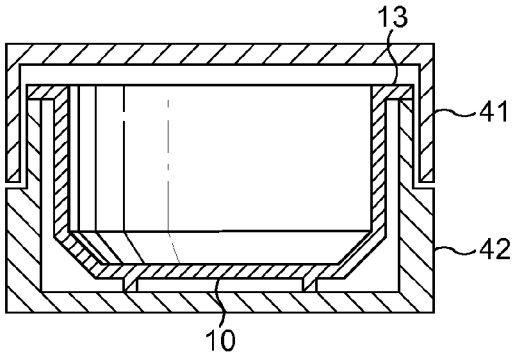
FIG. 9 shows a cross-sectional view of a container such as that shown in FIG. 8 having a refill unit of the invention disposed therein.

FIG. 9 shows a cross sectional view of container 40 having a refill unit in place, taken along the line IX-IX of FIG. 8. As can be seen in FIG. 9, bottom portion 42 has an indentation along the outer edge of the upper portion of its side such that top portion 41 sealingly engages bottom portion 42. For ease of illustration top portion 41 is shown just slightly raised from bottom portion 42 and no contents are depicted. A base 10 is positioned within bottom portion 42 and a lip 13 rests upon an upper edge of bottom portion 42.

It should be evident from the description and figures that the lip of the base serves to hold the base in position while allowing for full engagement of the seal in the existing container. In so doing, the refill unit may be used in conjunction with an existing container having the necessary structural integrity and barrier properties, while still keeping the moist smokeless tobacco products fresh.

Example 2

Screw-In Refill with Resealable Lid

An aluminium alloy moist smokeless tobacco container is provided which has a cylindrical shape. A thread is etched along the inner facing side wall of the bottom portion such that it can engage a refill unit having an outwardly extending thread along the outer facing side wall. The refill unit is formed of moulded plastic and has a partial top wall defining a circular central opening. A resealable lid is located over and completely seals shut the opening. A single-use pre-moistened cleaning wipe is provided with the refill unit.

A user consumes the product provided in the moist smokeless tobacco container and uses the cleaning wipe to clear any residue present in the aluminium alloy moist smokeless tobacco container. The user then places the refill unit in the container and lightly presses downward while rotating the refill to fully engage the threads and hold the refill unit in place. As desired the resealable lid is removed and contents consumed. Once the contents of the refill unit are all consumed, the user presses downward on the refill unit and rotates it in the opposite direction to free the refill unit from the container.

In such an embodiment, residues from the original batch of product are removed from the container thus minimizing degradation of the container. The contents of the refill unit are kept isolated from the aluminium alloy of the container by the base and resealable lid combination which serves both to keep the contents hygienic and to contribute to the long life of the container.

Example 3

Package with Plurality of Refill Units

An oval-shaped moist smokeless tobacco container having twenty pouches of 1 gram standard snus is provided. In addition, four oval-shaped refill units configured to fit inside the container are provided. In the first refill unit, twenty five grams of loose, cased, moist smokeless tobacco is provided. In the second refill unit, thirty pouches of 0.5 gram coffee-flavoured snus are provided. In the third refill unit, twenty five grams of moist liquorice-flavoured snuff is provided. In the fourth refill unit, twenty pouches of 0.7 gram menthol flavoured snus are provided.

The container and refill units are stacked, wrapped in a unit of cardboard to provide structural integrity and the wrapped stack is fixed in a shrink wrap. This configuration offers a consumer a variety of products with the minimum packaging necessary to keep the contents safe and clean and allow for easy, hygienic use.

Example 4

Package with Container and Drop-In Refills

A moist smokeless tobacco container having a square shape and formed of injection moulded plastic is provided.

An injection moulded plastic lid corresponding thereto is also provided.

Moist smokeless tobacco containers presently come in a variety of forms and shapes, and the present invention is not limited to any one or any class of forms or shapes whether existing or developed in the future. As used herein, relative terms such as up, down and the like are used to simplify the description of certain embodiments of the invention. They do not imply any mandatory orientation.

Modifications and improvements may be incorporated in a refill unit without departing from the scope of the invention. For example, graphics and/or indicia may be provided on none, some, or all of the surfaces of the refill unit by way of printing, imprinting, moulding, affixing labels, and the like.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

The invention claimed is:

1. Tobacco product packaging, comprising:

a rigid container; and a refill unit comprising:

a base portion comprising threads configured to engage opposing threads of the rigid container, and constructed of a material that provides a moisture barrier within the range from 0° C. to 40° C.;

a lid portion removably attached to the base portion to define a storage space; and the storage space contains moist smokeless tobacco;

wherein the base portion is configured to fit removably in the rigid container to provide a refill of moist smokeless tobacco in the rigid container.

2. The packaging according to claim 1, wherein the lid portion is resealably removable from the base portion.

3. The packaging according to claim 1, further comprising a wrapper disposed outside the attached lid and base portions.

4. The packaging according to claim 1, wherein the base portion further comprises:

a bottom wall and a side wall extending upwardly therefrom.

5. The packaging according to claim 4, wherein the bottom wall is circular and the side wall is cylindrical.

6. The packaging according to claim 4, wherein the bottom wall is oval and the side wall is elliptical.

7. The packaging according to claim 4, further comprising a lip extending outwardly from an upper edge of the side wall.

8. The packaging according to claim 7, wherein the lid portion is attached to the lip of the base portion.

9. The packaging according to claim 4, further comprising a lip extending inwardly from an upper edge of the side wall.

10. The packaging according to claim 9, wherein the lid portion is attached to the lip of the base portion.

11. The packaging according to claim 1, wherein the base portion further comprises an insect barrier.

12. The packaging according to claim 1, wherein the moist smokeless tobacco further comprises a flavourant.

13. The packaging according to claim 1, wherein the base portion material further comprises at least one flavourant.

14. A moist smokeless tobacco product, comprising:

at least one moist smokeless tobacco product container; and at least one refill unit comprising;

a base portion comprising threads configured to engage opposing threads of the moist smokeless tobacco product container, and constructed of a material that provides a moisture within the range from 0° C. to 40° C.;

a lid portion removably attached to the base portion to define a storage space Mien the lid portion is attached to the base portion; and the storage space contains moist smokeless tobacco;

wherein the base portion is configured to fit removably inside the moist smokeless tobacco product container to keep a moist smokeless tobacco product fresh.

15. A moist smokeless tobacco product, comprising:

at least one moist smokeless tobacco product container; and at least one refill unit comprising:

a base portion comprising threads configured to engage opposing threads of the moist smokeless tobacco product container, and constructed of a material that provides a moisture barrier within the range from 0° C. to 40° C., said base portion further comprising a circular bottom wall, a cylindrical side wall extending upwardly therefrom, and a lip extending from an upper edge of the side wall;

a lid portion resealably removably attached to the lip of the base portion to define a storage space when the lid portion is attached to the base portion;

the storage space contains moist smokeless tobacco; and a wrapper is disposed outside the attached lid and base portions;

wherein the base portion is configured to fit removably inside the moist smokeless tobacco product container to keep the moist smokeless tobacco product fresh.

* * * * *

UNITED STATES PATENT AND TRADEMARK OFFICE

CERTIFICATE OF CORRECTION

PATENT NO. : 8,820,521 B2
APPLICATION NO. : 12/598710
DATED : September 2, 2014
INVENTOR(S) : Richard Hodgson and Steve Dickason It is certified that error appears in the above-identified patent and that said Letters Patent is hereby corrected as shown below:

On the title page, item (30), under Foreign Application Priority Data, "0701087" should read -- 0701087-9 --;

In the Claims column 10, line 44, "C." should read -- C --;

column 10, line 45, "C." should read -- C --;

column 10, line 47, "Mien" should read -- when --;

column 10, line 61, both instances of "C." should read -- C --.

Signed and Sealed this
Second Day of December, 2014

Michelle K. Lee

Michelle K. Lee
*Deputy Director of the United States Patent and Trademark Office*